US010098485B2

(12) United States Patent
Hannula

(10) Patent No.: US 10,098,485 B2
(45) **Date of Patent: *Oct. 16, 2018**

(54) BED FOUNDATION COVER AND METHOD OF FABRICATION

(71) Applicant: Daniel Hannula, Abbotsford, WI (US)

(72) Inventor: Daniel Hannula, Abbotsford, WI (US)

( * ) Notice: Subject to any disclaimer, the term of this patent is extended or adjusted under 35 U.S.C. 154(b) by 427 days.

This patent is subject to a terminal disclaimer.

(21) Appl. No.: 14/645,147

(22) Filed: Mar. 11, 2015

(65) Prior Publication Data

US 2016/0066715 A1 Mar. 10, 2016

Related U.S. Application Data

(63) Continuation of application No. 14/262,243, filed on Apr. 25, 2014, now Pat. No. 8,997,280.

(51) Int. Cl.

| | |
|---|---|
| ***A47G 9/02*** | (2006.01) |
| ***A47C 31/10*** | (2006.01) |
| ***D05B 97/00*** | (2006.01) |

(52) U.S. Cl.

CPC ..... *A47G 9/0246* (2013.01); *A47C 31/10* (2013.01); *A47C 31/105* (2013.01); *D05B 97/00* (2013.01); *A47G 9/0238* (2013.01)

(58) Field of Classification Search

CPC ..... A47G 9/0246; A47G 9/0238; A47G 9/02; A47C 31/105; A47C 31/10

USPC .... 5/500, 499, 502, 497, 495, 482, 925, 926

See application file for complete search history.

(56) References Cited

U.S. PATENT DOCUMENTS

| | | | | |
|---|---|---|---|---|
| 2,162,755 A * | 6/1939 | Shauer | A47G 9/0246 38/140 |
| 2,586,031 A * | 2/1952 | Hahne | A47G 9/02 5/485 |
| 2,624,893 A * | 1/1953 | Harris | A47C 31/105 5/497 |
| 3,114,156 A * | 12/1963 | Cobb | A47G 9/0246 5/497 |
| 3,761,973 A * | 10/1973 | Leventhal | A61F 5/485 5/484 |
| 5,029,353 A * | 7/1991 | Kimball | A47G 9/0246 5/497 |
| 5,479,664 A * | 1/1996 | Hollander | A47G 9/0246 5/497 |
| 6,233,760 B1 * | 5/2001 | Cavazos | A47C 23/00 5/246 |

(Continued)

*Primary Examiner* — Robert G Santos

(74) *Attorney, Agent, or Firm* — Anthony J. Bourget

(57) ABSTRACT

A foundation or box spring cover for use in conjunction with a box spring comprising four panels configured to fit over edges of the box spring, at least two of the panels being adjacent panels of exposed, continuous, non-stretch fabric, and at least one stretchable panel positioned at a corner of the cover and configured to be oriented at an underside of the box spring. In one aspect the cover includes a hem configured to extend under the edges of the box spring, and where the triangular panel is off-set from the edges of the box spring. The hem is configured to have a concealed edge that operates to catch upon a bottom edge of the foundation to secure the sides of the cover into position so as to withstand a housekeeping action applied to the bedding such as tucking in bedding between a mattress and the foundation. A method of manufacture includes stretching the stretchable panel prior to sewing onto adjacent hems.

19 Claims, 9 Drawing Sheets

(56) References Cited

U.S. PATENT DOCUMENTS

| | | | | |
|---|---|---|---|---|
| 6,594,836 | B1 * | 7/2003 | Everson | A47G 9/0246 5/485 |
| 6,983,500 | B2 * | 1/2006 | Wootten | A47G 9/0246 5/497 |
| 7,240,383 | B2 * | 7/2007 | Stewart | A47G 9/0246 5/497 |
| 8,997,280 | B1 * | 4/2015 | Hannula | A47G 9/0246 5/497 |
| 9,795,231 | B2 * | 10/2017 | Smith | A47G 9/0246 |
| 2004/0040090 | A1 * | 3/2004 | Wootten | A47G 9/0246 5/497 |
| 2004/0068794 | A1 * | 4/2004 | Wootten | A47G 9/0246 5/497 |
| 2005/0011007 | A1 * | 1/2005 | Lintner | A47G 9/0246 5/497 |
| 2007/0056100 | A1 * | 3/2007 | Stewart | A47G 9/0246 5/497 |
| 2012/0066835 | A1 * | 3/2012 | Kelly | A47G 9/0292 5/493 |
| 2014/0317845 | A1 * | 10/2014 | Smith | A47G 9/0246 5/482 |
| 2015/0074907 | A1 * | 3/2015 | Skaggs | A47G 9/0246 5/497 |
| 2016/0066715 | A1 * | 3/2016 | Hannula | A47G 9/0246 5/499 |
| 2017/0354276 | A1 * | 12/2017 | Alletto, Jr. | A47G 9/04 |

* cited by examiner

BED FOUNDATION COVER AND METHOD OF FABRICATION

CROSS-REFERENCE TO RELATED APPLICATIONS

This application claims the benefit and priority of Provisional Patent Application Ser. No. 61/915,955 filed Dec. 13, 2013, for BOX SPRING COVER under 35 U.S.C. § 119(e), and co-pending utility application Ser. No. 14/262,243 filed Apr. 25, 2014. Each of the aforementioned applications is hereby incorporated herein by reference in its entirety for continuity of disclosure.

BACKGROUND OF THE INVENTION

1. Field of the Invention

The present invention relates to a cover for a bed foundation or box spring, and more particularly to a foundation cover having stretchable corner elements.

2. Background Information

There are many types of box spring covers. Most all of the covers suffer from a problem of causing a fabric ripple at areas of the box spring which results in the box spring looking unfinished even when the bedding has been placed and/or adjusted on the bed and box spring. A typical box spring cover includes an elastic band that surrounds the perimeter or opening of the cover and causes the edges of the cover to draw together. While the edges around the corners may look finished, the typical box spring cover shows ripples, typically at a middle portion of the box spring. FIG. 1 shows a prior art box spring cover that utilizes an elastic band and results in a ripple of fabric 100. Ripple 100 is shown having a rippled or wavy structure along an edge (such as a bottom edge) or side of the box spring. The non-smooth appearance makes the otherwise finished bed look unfinished. Service workers or professionals expend great efforts in attempts to solve the wrinkling problems or to make the bedding look as smooth as possible. Further, the manufacture of uniformly functioning covers is especially difficult given the variability of materials (for instance, different fabrics have different stretch properties; and even an elastic band has varying tension forces along its length so that a uniform force is difficult to provide). Such wrinkling problems have been occurring for as long as box springs or bed foundations have been used.

Some examples of box spring covers (or even mattress covers) include those found in patents such as U.S. Pat. No. D615,795, U.S. Pat. Publication No. US 2012/0066835, U.S. Pat. No. 6,233,760, U.S. Pat. No. 2,499,698, U.S. Pat. No. 5,479,664, U.S. Pat. No. 2,624,893, and U.S. Pat. No. 5,029,353. While these patented items and other systems may have useful features, there is room for improvement.

SUMMARY OF THE INVENTION

The present cover is configured to seal all four corners of a bed foundation or box spring. The cover produces a clean, crisp, tight fit about the foundation and inhibits ripples or wrinkles at side panels. Components of the cover are designed to secure into position with little or no adjustment needed in order to keep the components tucked into position. The cover is configured to remain in position and avoid becoming dislodged or having the side panels inadvertently drawn between the foundation and the mattress when housekeeping is making the bed.

In one aspect the invention includes a cover for placement on a bed foundation having a set of four side panels configured in a rectangular orientation to define four corners and to fit over edges or sides of a bed foundation and having at least one stretchable corner panel positioned at one of the corners where an entirety of the stretchable corner panel is positioned at an underside of the corner. In one aspect a hem of the cover is oriented to maintain a horizontal position and includes a rough edge which is positioned adjacent a bottom edge of the foundation to inhibit release of the hem from underneath the foundation. The retention of the hem reduces or eliminates rippling of the side panel so that a smooth appearance of the cover is easily maintained.

In a further aspect, the invention includes a box spring cover for use in conjunction with a box spring comprising four panels configured to fit over edges of a box spring, at least two of the panels being adjacent panels of exposed, continuous fabric, and at least one stretchable triangular panel positioned at a corner of the cover and configured to be oriented at an underside of the box spring. In one aspect the cover includes a hem configured to extend under the edges of the box spring, and where the triangular panel is off-set from the edges of the box spring and concealed from view. In further aspect an elastic panel is configured to urge the hem of the cover into a horizontal orientation so that a linear rough edge of the hem is positioned to abut with a bottom edge of the foundation in order to inhibit displacement of the cover. Means for inhibiting displacement of the cover provides a smooth appearance at the sides of the foundation.

Methods of manufacture of a cover and methods of fitting a cover to a box spring include stretching an underside stretchable panel prior to sewing the panel to a hem. In a further aspect the method includes use of a triangular shaped stretchable panel having an angle defined by legs of the triangle where the angle measures less than 90 degrees when the panel is in an unstretched state.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
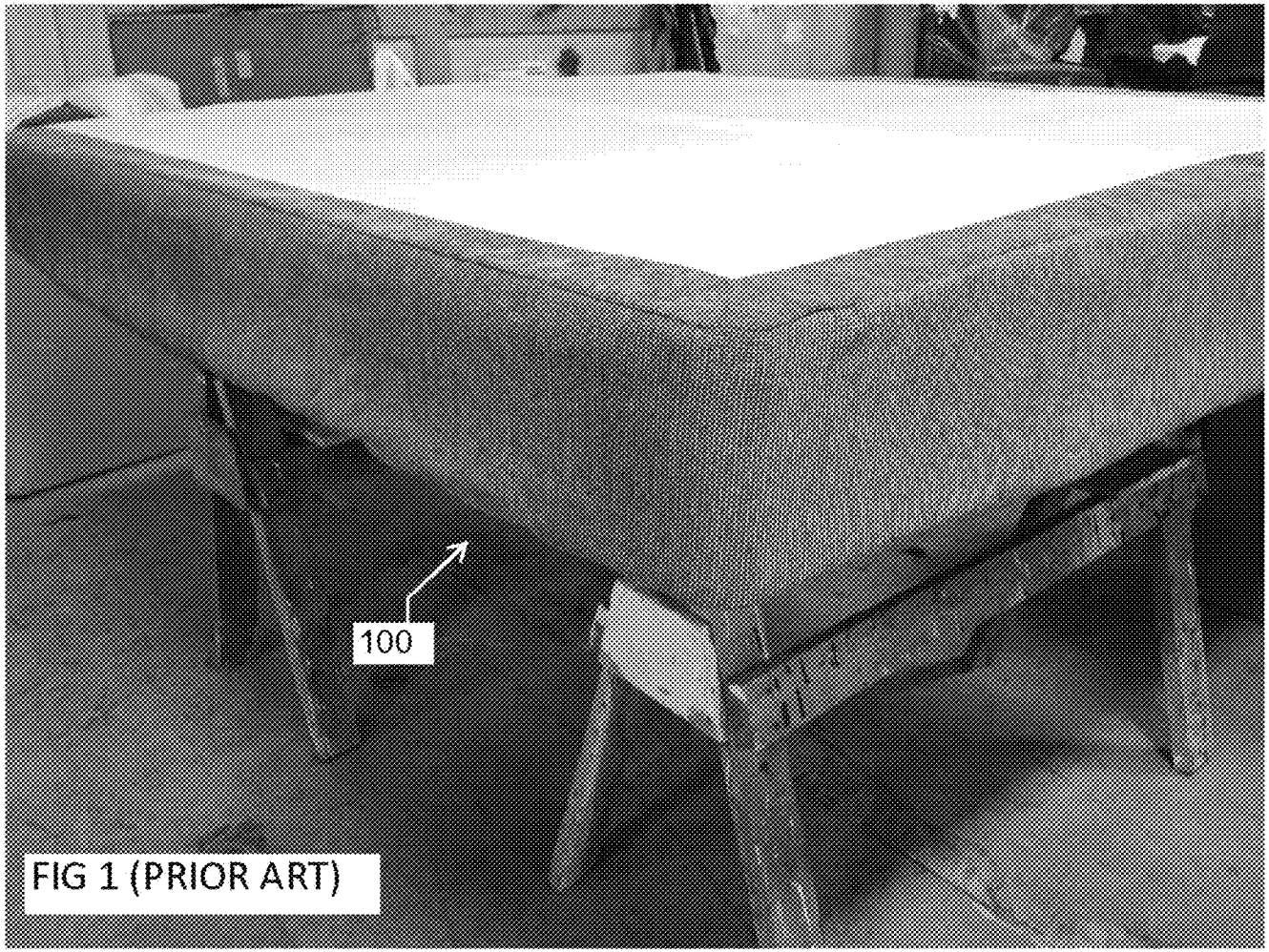
FIG 1 (PRIOR ART)
FIG. 1 is a prior art cover placed upon a box spring showing a ripple 100 of fabric along an edge or side panel of the covered box spring.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 2:
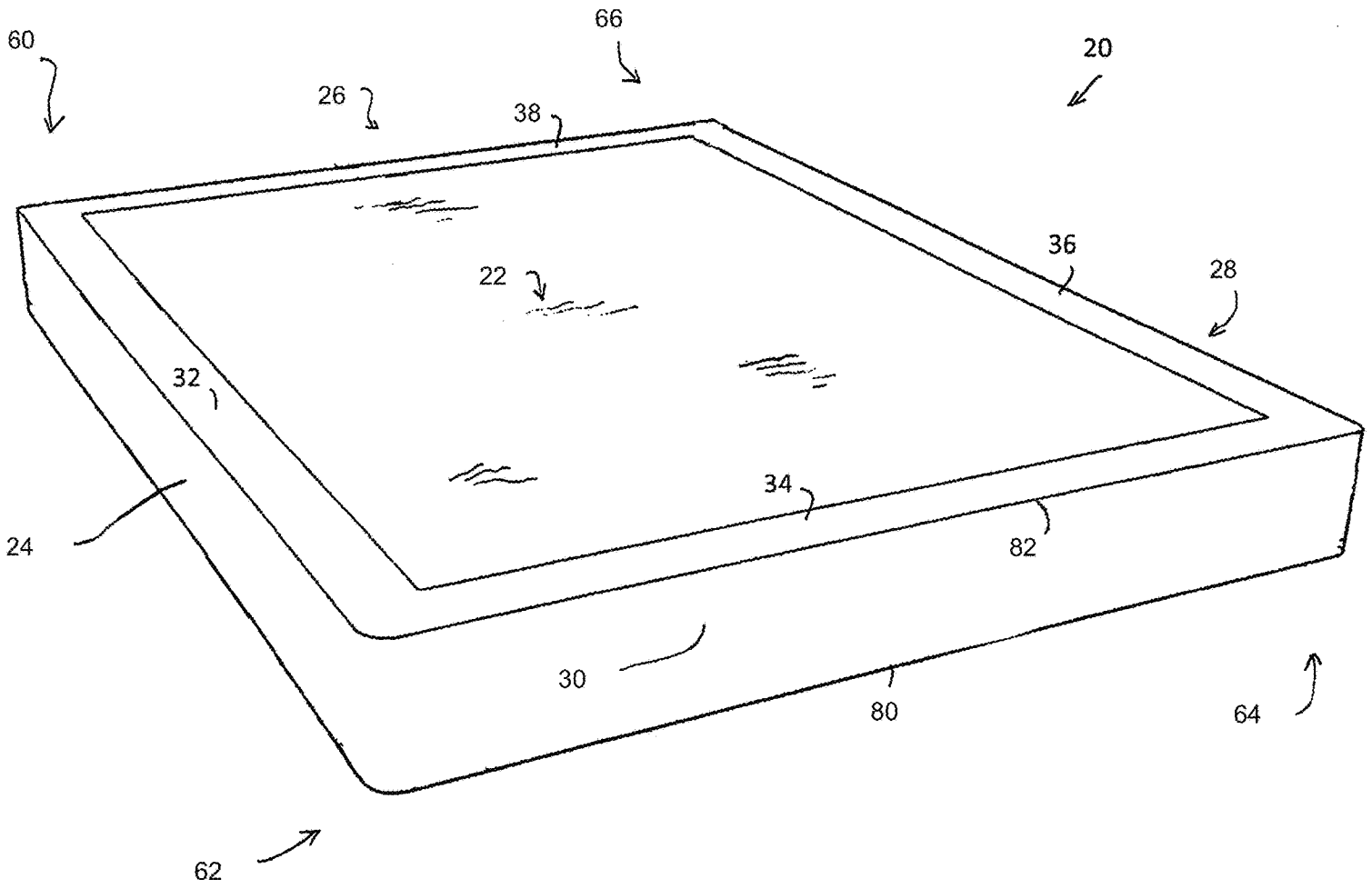
FIG. 2 is a perspective view of a box spring cover in accordance with one aspect of the present invention and showing the cover placed on a box spring (the box spring is hidden from this view).

Referring to FIGS. 1-10, aspects of the box spring cover 20 are shown. In one aspect, cover 20 includes a decking panel 22 (See FIG. 2) as a top layer which overlays a top of a box spring. Side panels 24, 26, 28, 30 extend from panel 22 to cover edges of the box spring. Panels 24, 26, 28, 30 are oriented in a generally rectangular configuration. It may be appreciated that panels 24, 26, 28 and 30 are "drops" which extend generally vertically from the decking 22 or platform 32, and which cover the sides, head and footer of the box spring. As shown in FIG. 2 a side panel 30 is positioned at a side of the foundation and between a bottom edge 80 and a top edge 82. In one aspect a platform 32, 34, 36, 38 is oriented generally horizontally with respect to side panels. In one aspect, platform is a 4 inch decorative fabric and may be part of decking panel 22. Platform 32 may have width greater or lesser than 4 inches as desired. In another aspect (See FIG. 9) a "hugger" variety of cover 20 may be used where decking panel 22 (or platform 34, for instance) is only partially covering the top of box spring or foundation 90. Decking panel 22 may be eliminated in favor of a platform 32, for instance. It may be appreciated that platform may be other than a 4 inch fabric depending on the size of mattress or application. Platform 32 is typically a decorative fabric such that in a case when a mattress placed upon the box spring is moved, the decorative aspect of platform 32 may still be visible which improves the appearance. Decking panel 22 and platforms 32 and side panels 24 (and hem 50 as noted below) may be made from common bedding materials. It may be appreciated that many different types of fabrics may be used. In many cases the fabrics are relatively nonextendable conventional fabrics. It may be appreciated that different fabrics having different stretch characteristics may be used. The characteristics of the fabrics may depend on the thickness of the fabric, the tightness or loosness of the weave, whether the fabric is non-woven, the number of layers used, the type of fabric (i.e., polyester, cotton, silk, wool, polycotton, nylon, etc.) and other characteristics. Top edge 82 in one aspect may include a seam which connects a panel, such as panel 30, to a platform, such as to platform 34.

Figure 3:
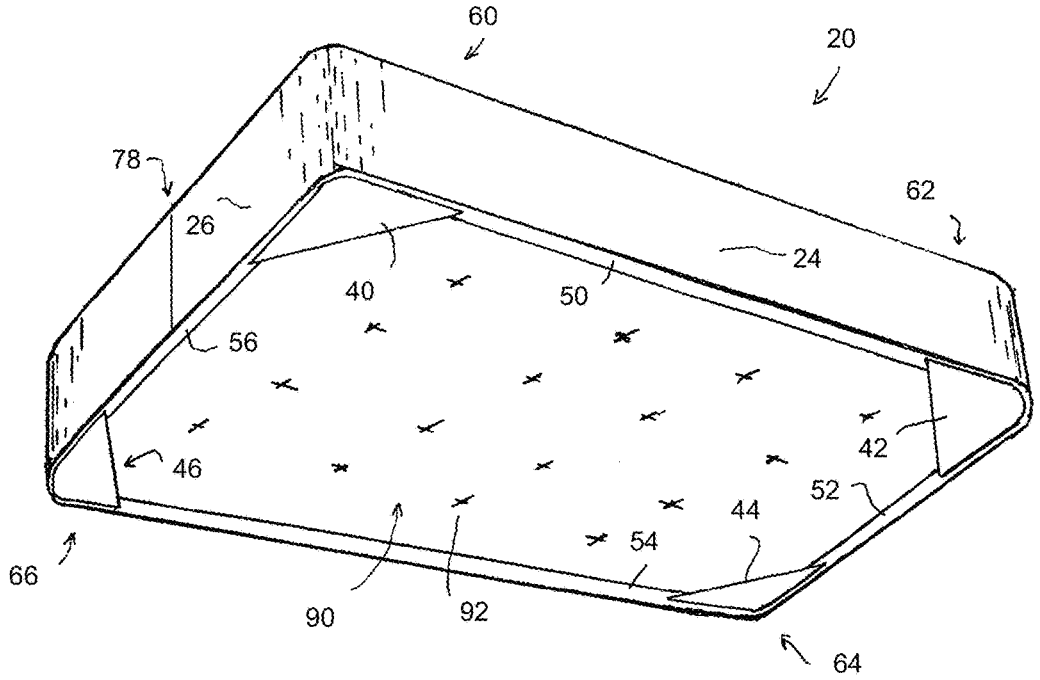
FIG. 3 is a bottom perspective view of a box spring cover in accordance with one aspect of the present invention and showing the cover placed on a box spring.

FIG. 3 shows a bottom perspective view of a further aspect of a cover 20 positioned on a bed foundation such as a box spring 90. Foundation or box spring 90 may include a structure that has springs or may also be any other variety of materials that serve as a foundation upon which a bed mattress is positioned. In some instances a foundation 90 may include a foam foundation or combination of foam, springs, wood, metal or other materials. Box spring 90 in this view includes a screen 92. Screen 92 is typically a light-weight fabric that may be stapled, for instance, to the structural supports of box spring 90. Screen 92 in some instances includes a light-weight black colored fabric or ticking fabric used to screen from view the inside areas of box spring 90. A typical box spring or foundation 90 will include side structure elements (such as structure 94) to form the outline of the foundation. In many cases the foundation structure elements are formed of wood or comprise a wooden frame. In one aspect panel 24 and panel 26 comprise a continuous fabric material wrapped around corner 60.

As shown in FIG. 3, cover 20 includes stretchable panels 40, 42, 44, 46 positioned at each of corners 60, 62, 64, 66. In one example, the stretchable panels may be triangular stretchable panels. A panel, such as stretchable panel 40 may be made of a variety of materials. In one aspect, panel 40 may include elastic strands embedded within fibers or woven fibers to allow panel 40 to stretch. A variety of types of stretchable materials may be used. The stretch characteristics of a panel such as panel 40 may vary depending on many different factors, such as the thickness of the panel, the amount or spacing of the stretchable materials within the panel, the type of stretch material used (i.e., types of elastic bands or threads), etc.

Cover 20 includes a hem 50. Hem 50 is designed to be positioned at an underside of box spring (See FIG. 3). Hem 50 extends from side panels, such as panel 24. Hem 50 and panel 24, for instance, may comprise the same layer of folded material. In one aspect hem 50 is a one inch folded hem (i.e., about one inch after being folded as noted below), although different widths may be used. Hem 50 extends between adjacent corners, such as between corner 60 and corner 62. In one aspect a hem 50 will span the entire length between corners. In other aspects a hem 50 will span substantially the length between corners. A hem 52, 54, and 56, for instance, may be positioned between the remaining adjacent corners as shown in FIG. 3.

Figure 4:
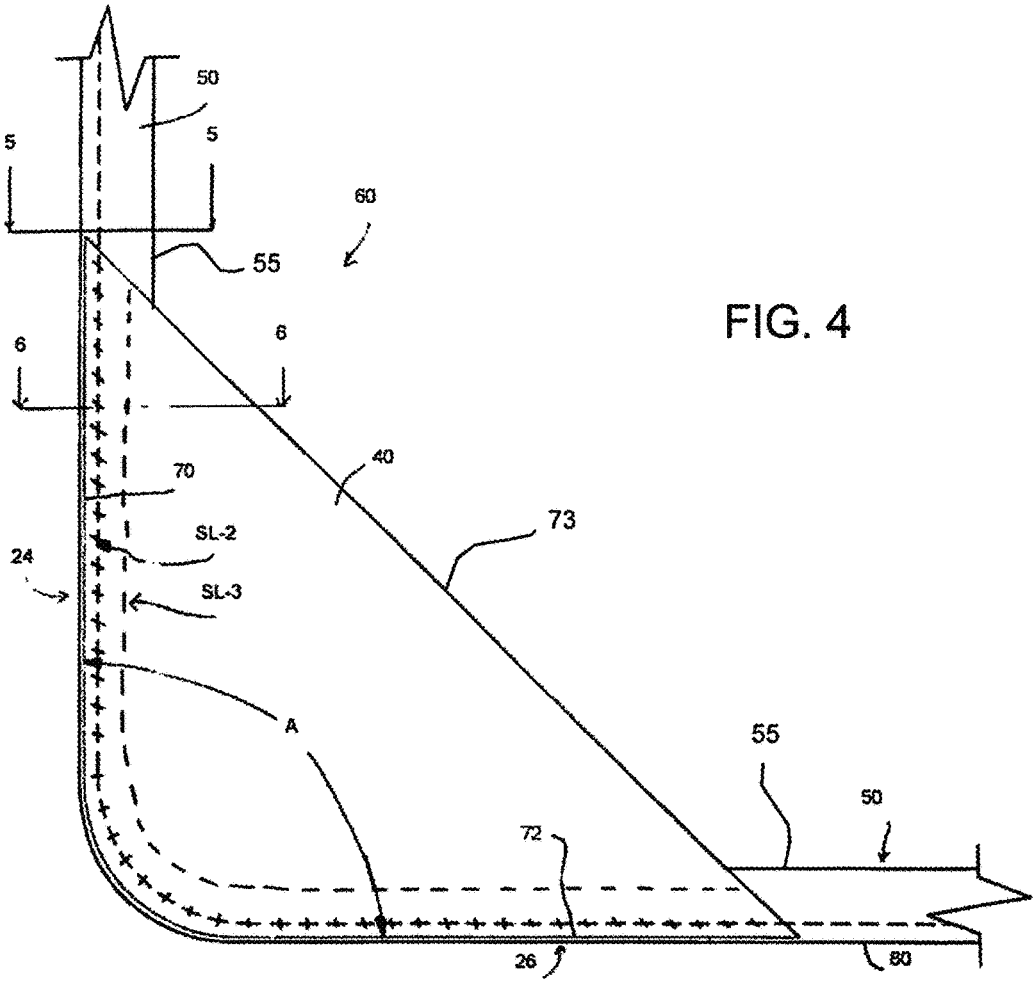
FIG. 4 is a partial bottom view of a corner aspect of the present invention.

FIG. 4 shows a panel 40 of corner 60 secured to cover 20 at hem 50. In this aspect panel 40 is a stretchable triangular panel 40. The remaining panels may be triangles 42, 44 and 46 may be similarly secured to cover 20 at their respective corners. It may be appreciated that hem 50 and panel 40 are oriented substantially horizontally in FIG. 4.

Figure 5:
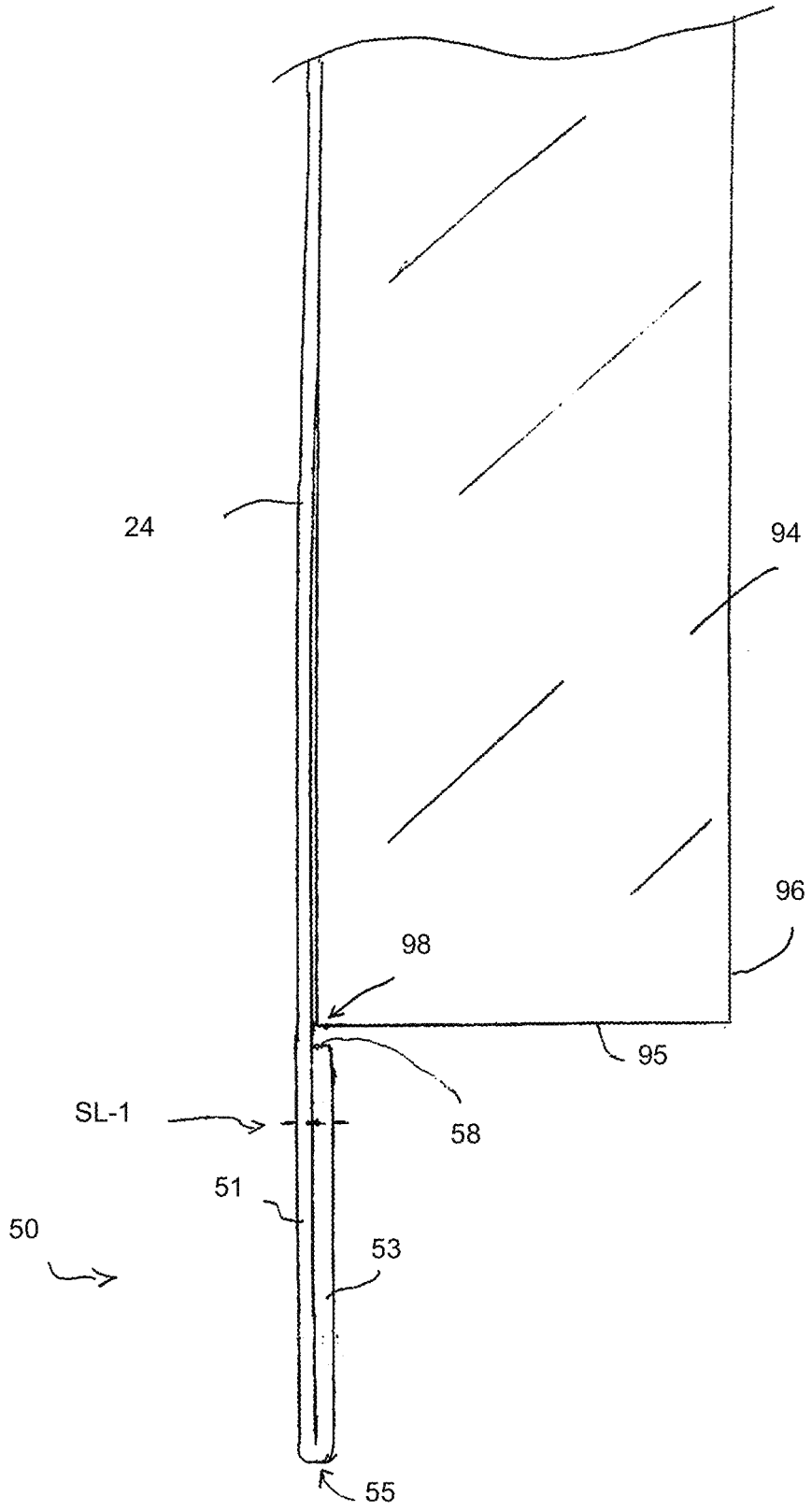
FIG. 5 is a modified section view of a corner aspect of the present invention taken along line 5-5 of FIG. 4.

FIG. 5 is a modified partial section view of side panel 24 and hem 50 of cover 20 taken generally along line 5-5 of FIG. 4. FIG. 5 also shows side panel 24 in relationship to a box spring side structure 94. Structure 94 is typically a wooded structure which in conjunction with other structural members and materials comprise box spring 90. Structure 94 is depicted in relation to side panel 24 to show the relative positioning of panel 24 when cover is placed on box spring 90. FIG. 5 depicts hem 50 as extending below structure 94 as a frame-of-reference and as an interim step in the fabrication of cover 20. It may be appreciated that hem 50 is or should be shown as oriented generally horizontally in a section view along line 5-5 but is shown as oriented vertically for illustration purposes only (which vertical orientation of hem 50 may be the case in the absence of panel 40, i.e., without panel 40, hem 50 would tend to drop downward). In fabrication of cover 20 the side structure 94 is not typically present but is shown in FIG. 5 for illustrative purposes only. Hem 50 includes afoot 51 and a toe 53. Toe 53 wraps back upon foot 51 and forms a fold edge 55. A stitch, depicted by stitch line SL-1 is used to secure toe 53 to foot 51. It may be appreciated that a stitch along stitch line SL-1 may extend the length of hem 50, such as between corner 60 and corner 62, for example. At the terminal end of toe 53 is rough edge 58. Rough edge 58 also extends the length of hem 50.

Figure 6:
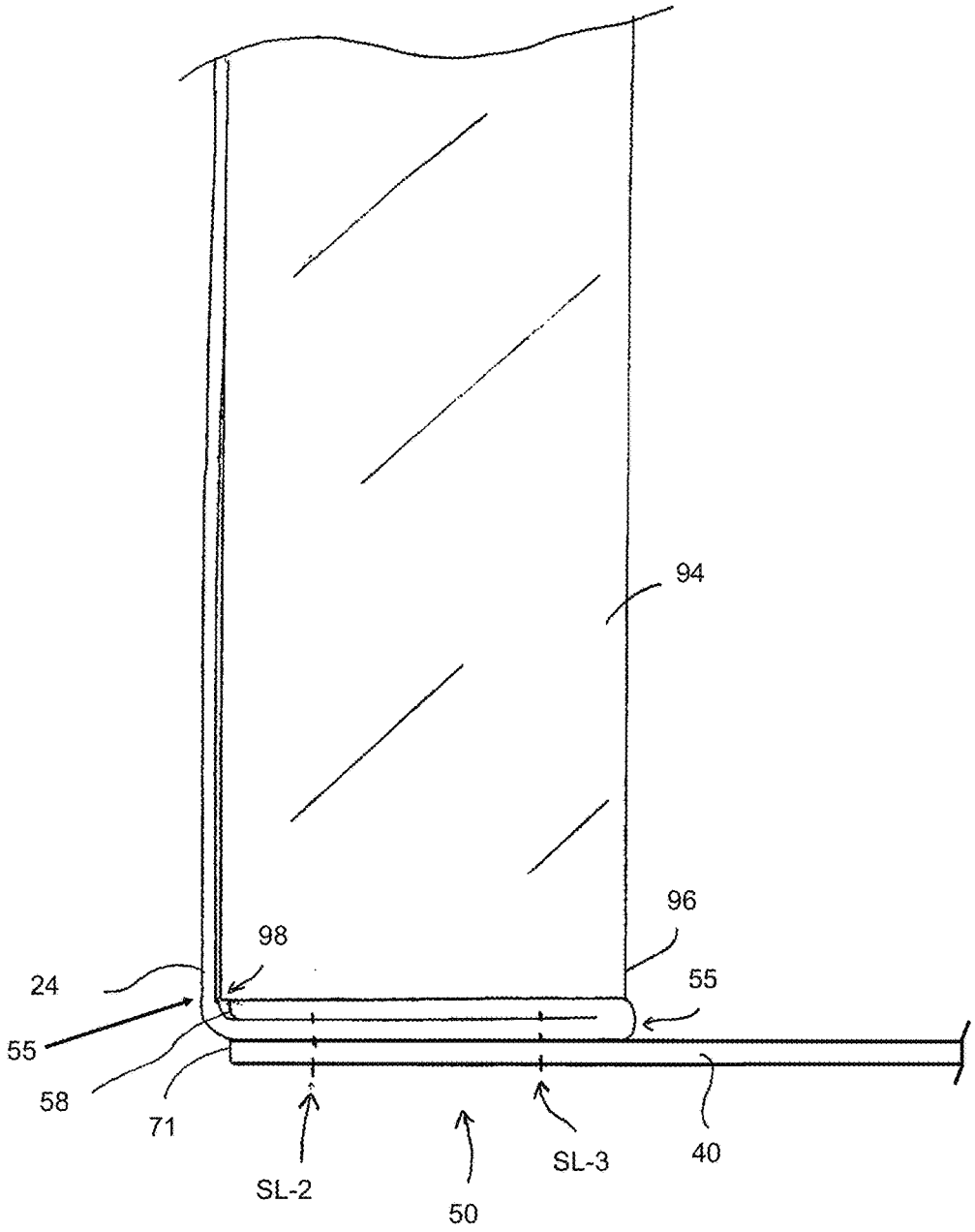
FIG. 6 is a section view of a corner aspect of the present invention taken along line 6-6 of FIG. 4.

FIG. 6 is a partial section view of side panel 24 and hem 50 of cover 20 taken generally along line 6-6 of FIG. 4. Hem 50 is folded underneath edge 95 of side structure 94. More particularly, hem 50 is folded and stitched such that when cover 20 is placed on box spring 90, hem 50 will be positioned underneath and/or will lie against and along edge 95 of structure 94. In one aspect toe 53 will lie against edge 95. In other aspects a pad or filler material may be inserted between hem 50 and edge 95. Stretchable triangle panel 40 is secured to hem 50. In one aspect a stitch is positioned at stitch line SL-2 to secure panel 40 to hem 50. It may be appreciated that SL-2 may overlap and/or coincide with SL-1. As may be appreciated, stitch line SL-3 in conjunction with stitch line SL-2 tend to cause hem 50 to be oriented relatively horizontally.

In one aspect side structure 94 has a thickness of about 1 inch. In such case hem 50 will have a length of about 1 inch or of a length sufficient to extend to or past the end wall 96 of structure 94 (See FIG. 6). In this manner hem 50 will conceal structure 94 from bottom view. Where hem is about 1 inch in length, in one aspect stitch line SL-1 may be positioned about ¾ of an inch from fold edge 55 (or about ¾ the length of hem 50 which extends from side panel 24). While in this example the hem 50 is configured to have a length of about 1 inch, it may be appreciated that different lengths are possible depending on the thickness of structure 94. An additional or third stitch line SL-3 may be used to further secure triangle 40 to hem 50. Use of a third stitch line SL-3 assists in urging or forcing hem 50 to retain a generally horizontal orientation.

In one aspect, toe 53 may be made of the same material as foot 51. Foot 51 may be made of the same material as side panel 24. In a further aspect, toe 53 may be made of a different material as compared to the material of foot 51. In one aspect, toe 53 is made of a rubberized and/or a polymer material or other gripper cloth product or additive having a texture and ability to adhere or have a greater friction relationship with edge 95. In an example where toe 53 is a rubberized layer, toe 53 will exhibit a greater tendency to resist a sliding movement when side panel 24 is forced upward, for instance. A gripping material applied to toe 53 or comprising toe 53 will help toe 53 to grip against edge 95 (which helps maintain hem horizontally) to better secure cover 20 into position.

As shown in FIG. 4, triangle 40 extends from side 24 to side 26. Particularly, triangle 40 may be stitched along hem 50 which extends from side panel 24 to hem 50 which extends from side panel 26. At a corner area cover 20 defines a 2 inch radius, for instance. A two-inch radius is a common curve radius used to fit box springs or foundations of the variety shown.

Figure 7:
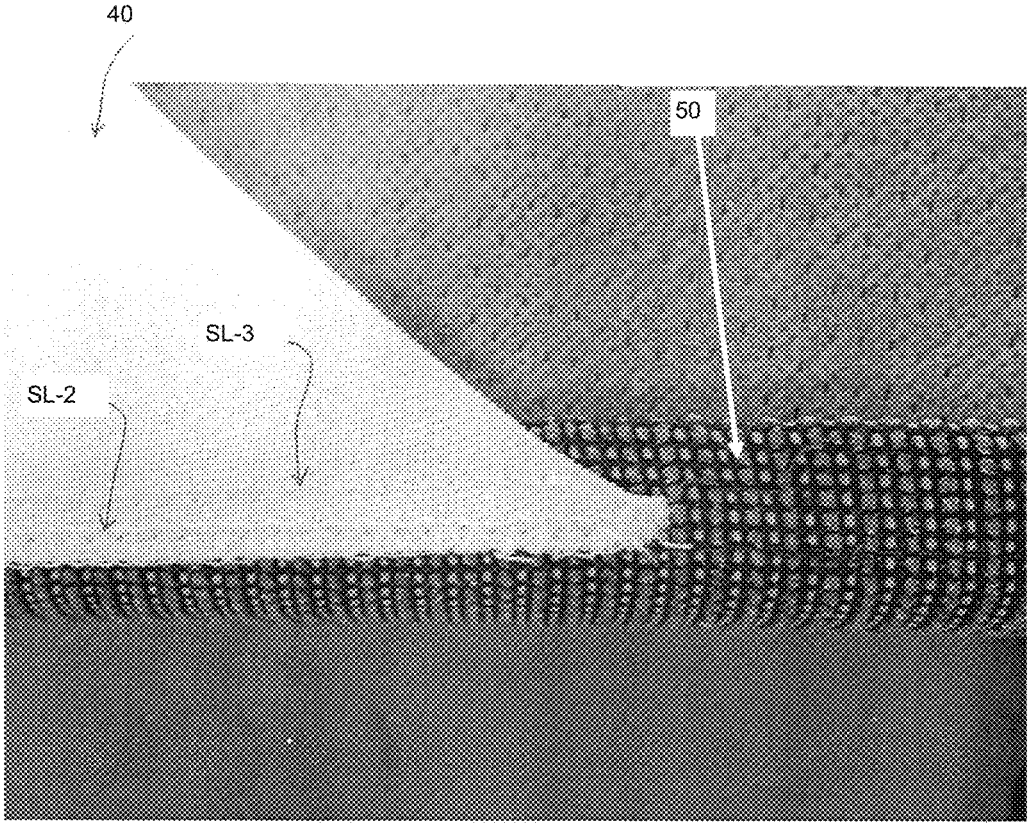
FIG. 7 is a partial bottom perspective view of a corner aspect of the present invention.

With reference to FIG. 6 and FIG. 7, triangle 40 is shown as secured to hem 50. It may be appreciated that triangle 40 overlaps hem 50 and includes a double stitch, where at least one stitch is along stitch line SL-2 (which stitch itself may be positioned along or on top of, at least in part, stitch line SL-1) and at least another stitch is along stitch line SL-3. Side structure 94 includes an outer corner 98 that forms a bottom corner edge which runs the length of box spring side structure 94. First leg 70 of triangle 40 includes a first leg edge 71 which is positioned at or near outer corner 98 (See FIG. 4 and FIG. 6). In one aspect first leg edge 71 is positioned off-set from outer corner 98 so that first leg 71 is concealed or better concealed from view. For instance, first leg edge 71 is recessed inward from a plane defined by an outermost portion of panel 24. As may be appreciated from FIG. 7, hem 50 may be made of material that produces a soft curve or padded aspect so that the respective edges are softer or less likely to cause scrapes or injury to a person. In some aspects a padding material may be included within or behind hem 50 to provide a more comforting structure. It may also be appreciated that side panel 24 may also include material and/or a padding material. In further reference to FIG. 7, it may be appreciated that first leg edge 71 is off-set inward from a bottom edge 80 or a plane defined by an outermost portion of the rounded side panel 24.

In a further aspect with reference to FIG. 6, at least one of the side panels 24 and one of the hems 50 define an elbow 65 having a generally perpendicular internal angle. Terminal edge 58 is positioned adjacent elbow 65 within the internal angle. It may be appreciated that elbow 65 is configured to cover outer corner 98 of side structure 94 of foundation 90.

In further reference to FIG. 4 and FIG. 7, a third leg 73 of panel 40 has a length greater than a length of first leg 70 and a length greater than a length of second leg 72. Third leg 73 also crosses over or overlaps fold edge 55. Third leg 73 may cross over or overlap each of the respective fold edges 55, 55 of respective adjacent hems 50, 50 as shown in FIG. 4. Third leg 73 extends past fold edge 55 toward bottom edge 80.

In one aspect, panel 40, which is a flexible or elastic triangular material, is stretched across corner 60 and secured, for instance by sewing, into position as shown. When cover 20 is fitted upon a box spring 90, corner 60 will fit upon a respective corner of the box spring such that triangle 40 is positioned at an underside of the box spring. Also, with such fitting, hem 50 is urged or required to lay flat or relatively horizontal with respect to box spring edge 95. For instance, the elastic force of triangle 40, together with the stitching of stitch line SL-2 and/or SL-3, causes or tends to cause hem 50 to lay flat. The combination of SL-2 and SL-3 enhances the horizontal urging of hem 50 (i.e., at least the material of hem 50 positioned between stitch lines SL-2 and/or SL-3 is held flush against panel 40 and urges the remainder of hem 50 to a similar orientation). Further, due to the pulling action of triangle 40, the hem portion 50 associated with side 24 is urged toward the hem portion 50 associated with side 26. This stretching force caused by triangle 40 pulls the respective hem portions to help maintain the hem portions is a flat or relatively horizontal orientation. Because hem 50 will lay flat along edge 95, side panel 24 will experience a sufficiently tight fit along the length of the box spring 90 to avoid the wrinkle problem noted above (i.e., side panel 24 and hem 50 will fit smoothly and continuously against the box spring 90 along the structure 94 and edge 95 that runs from corner 60 to corner 62, for instance).

Figure 8:
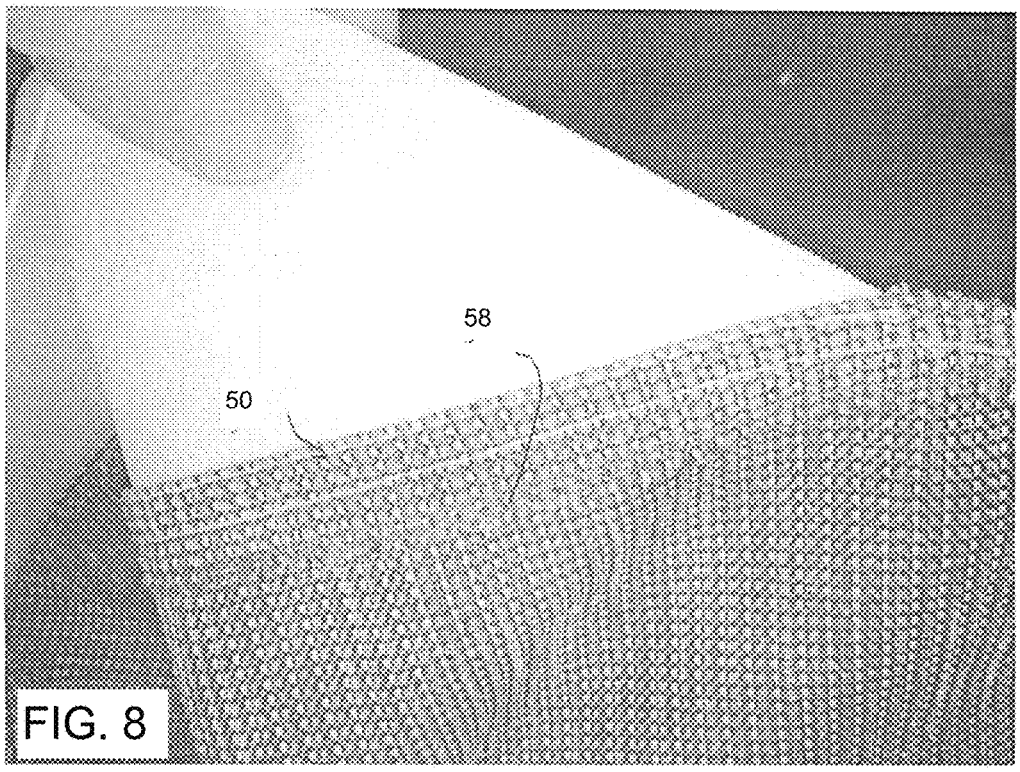
FIG. 8 is a partial bottom perspective view of a corner aspect of the present invention.

Further, and due at least in part to having exposed terminal edge 58, a friction line is created between terminal edge 58 and outer corner 98 (See FIG. 6). Rough edge 58 may also be seen in FIG. 8. FIG. 8 is a perspective view of a corner portion of cover 20 where a corner, such as corner 40 is turned inside-out for clarity. It can be seen that rough edge 58 runs along hem 50. As flexible triangle 40 applies force to urge hem 50 against box spring side structure 94 (see FIG. 6, for instance), terminal edge 58, which may abut or catch upon outer corner 98, allows for resistance against upward sliding of panel 24. In other words, if side panel 24 pulls upward away from edge 95 (or experiences a force in that direction, such as when a housekeeper tucks bedding in between the mattress and the foundation), rough edge 58 will catch or tend to catch at corner 98 along the length of box spring side structure 94 running from corner 60 to corner 62, for instance. Maintaining hem 50 in a relatively flat orientation (due at least in part to the pull of triangle 40 and the double stitch lines SL-2 and SL-3) provides further assurance that rough edge 58 will catch against corner 98. Having such catching action between edge 58 and corner 98, which runs the length of the side structure 94 will reduce or eliminate sag of side panel 24 and/or the associated wrinkle problem. Side panel 24 therefore enjoys a secure and smooth fitting against box spring 90 which runs the length of hem 50 between corner 60 and corner 62, for instance.

It may be appreciated that a shorter span of material, such as the span of hem 50 between corner 60 and corner 66, for instance, is less likely to sag or wrinkle as compared to a longer span of hem 50 which runs between corner 60 and corner 62. It may be appreciated that different types of fabrics which comprise sides 24 and hem 50, for instance, may require different sizes or types of panels 40 to maintain the smoothing feature noted above. In one non-limiting example, if sides 24, 30 are made of a polymer and/or cotton or poly/cotton blend and configured to span a length of the side of foundation such as span the side of a king-size foundation (76 inches by 80 inches), a panel 40 (positioned at each corner 60, 62, 64 and 66) having a first leg 70 and second leg 72 each measuring 8 inches may be sufficient to cause hem 50 to lay flat or horizontally underneath structure 94 such that side panel 24 exhibits a smooth appearance for the entire length of the foundation 90 (i.e., there are no ripples of panel 24). If the length of first leg 70 is reduced to 7 or 6 inches, for instance, the forces urging hem 50 to lay flat are reduced along the length of the foundation (i.e., hem 50 may sag at a middle area), which lessens the ability or likelihood that rough edge 58 will "catch" upon outer corner 98, thus potentially causing panel 24 to experience a wrinkle. It may be appreciated that the size or nature of panel 40 (or lengths of legs 70, 72) together with the length of foundation 90, and further together with the stretch or inherent sag characteristics of the fabric of side 24 and/or hem 50, will impact the tendency of side panel 24 to wrinkle. For some fabrics a greater (or lesser) length of panel legs 70, 72 will be desired or needed to maintain side panel 24 as wrinkle-free. In some cases, and depending on the type of fabric and span lengths of the foundation 90, a smaller sized panel 40 may be used which in turn saves costs since less material is required to create cover 20. In other cases a larger sized panel 40 will be desired or required in order to provide the better fitting characteristics and anti-wrinkle feature. It may be appreciated that there can be numerous sizes and varieties of covers to fit the numerous sizes of foundations and which utilize numerous different types of fabrics or materials. For instance, a foundation can be of many different sizes. A standard full-size foundation is typically 54 inches by 78 inches, a standard Queen is 60 inches by 80 inches, and a standard king-size is 76 inches by 80 inches (a "California King" measures 72 inches by 84 inches; a "hotel king" runs 72 inches by 80 inches, although some may have an actual measurement of 70½ inches by 79½ inches to save material costs). Since different fabrics have different stretch characteristics, and a volume of covers 20 may need to be manufactured for a variety of different sized foundations, it has heretofore been very difficult to efficiently create a working prototype for a given project. Use of the current panel 40 and hem aspects, however, allow for efficiency in developing prototypes and production model covers 20 that fit smoothly and without the wrinkle problems.

In a further non-limiting example, cover 20 may include a king size cover (76 inches by 80 inches) with decking 22 made of a poly/cotton blend (containing between about 50-75% poly, for instance, and 25-50% cotton) with a 4 inch platform 34 strip, and unlined side drop (such as drop 24) with one inch single needle lock stitch hem, a closed at headboard end, with the drop length to finish one inch below the foundation, with thread of 100% polyester, color to match the fabric 22, with all four panels such as panel 40 being generally triangular elastic material with legs of 9.75 inches by 9.75 inches and 13.5 inch hypotenuse and two inch radius corners, with hems and attachment of returns to be 8 stitches per inch. It may be appreciated that a variety of different styles and types of covers may be manufactured to accommodate use on numerous (and almost limitless) varieties of foundations.

A box spring cover that is made of material which might otherwise result in a wrinkle or sagging situation when configured with the present hem and elastic features will experience improved anti-sag or anti-wrinkle features. Thus, a greater variety or number of different types of fabrics can be used while still offering a clean and wrinkle free solution. A greater selection of material types allows for increasing options for customers and saving money in having a variety of types of materials to choose from. Moreover, use of the elastic panels reduces troubles associated with the manufacture of traditional covers that include a one-inch elastic strap positioned at the opening of the cover. By using elastic triangles, as opposed to using a one-inch elastic strap positioned at the opening of the cover, a manufacturer is able to develop working prototypes much more quickly since a more uniform tension is applied and the hem may be more easily maintained horizontally to positioned the rough edge at the outer corner of the foundation. A manufacturer is able to easily create a workable solution for a particular type of fabric (taking into consideration the types of weave or no weave of the fabric, length and width and height of the foundation, size of triangular panels, whether the fabric is printed or quilted, which impacts the stretch of the fabric, etc.). In some cases a 7 inch triangle may be sufficient to assure a smooth fitting of a cover 20 while in others a different sized triangle will be sufficient. Simply altering the size of the triangle to create a working prototype to use as a specification or model for producing large lots of covers greatly speeds the development and production (and reduces costs) of finished covers 20 while increasing the uniformity of fit among the produced covers 20. Optimally sizing panels 40 will further reduce the cost of materials.

It may be appreciated that different types of materials or fabrics that are used to make the respective panels and hems will impact the tensions and fitting aspects of cover 20 upon box spring 90. For instance, a cover 20 which is made of relatively flexible or loose knit fabric which is allowed to stretch to a greater degree, as compared to other fabrics, will tend to sag or loosen from a side panel of box spring 90 which may tend to result in an undesired wrinkle situation. Materials or bedding fabrics that have less inherent or natural stretching characteristics tend to exhibit a greater ability to maintain a smooth appearance over a longer length or span of a box spring. Yet such flex-resistant bedding materials may be more difficult to secure to the box spring and/or may be an undesirable bedding texture. There are numerous different varieties of materials having different stretch properties. Matching an appropriate material to different sizes of box springs to lessen the wrinkle problem can sometimes be a significant challenge. It may be appreciated that the present invention allows for greater versatility and options in the use of different materials to lessen the wrinkle problem.

As referenced above, it may also be appreciated that different types and/or sizes of triangles 40 may also impact the orientation of hem 50 and thus the anti-wrinkle features of cover 20. For instance, in a further aspect triangle 40 includes a first leg 70 and second leg 72 that measure about 6 inches (i.e., triangle 40 has legs that are generally 6 inches by 6 inches). Where the span or length between corner 60 and corner 62 is a relatively long distance, hem 50 might tend to sag or experience a looser fit toward the middle of the box spring (i.e., due to less tension from triangles 40, 42, acting on hem 50 at the middle portion). Configuring the triangles 40, 42 with a longer leg length (i.e., having first leg 70 and second leg 72 that are about 7 inches) will provide a greater tension force to hem 50 at the middle area of the box spring. A manufacturer may configure each cover 20 to have a desired material (with desired stretch or anti-stretch properties) and a desired triangle structure to accommodate a smooth fitting on a selected box spring. Further, triangles 40 may be made of a variety of types of flexible material so that the forces exerted upon hem 50 may vary as desired. The flexibility may be adjusted in order to create a cover having the desired anti-wrinkle characteristics.

Given the many variables to choose from for bedding (i.e., length, width and depth of the box spring, type of materials used for the cover or different parts of the cover 20 (i.e., loose knit, stretchy, etc.), the size of triangles (i.e., length of the legs, angle of the triangle), and type of flexible material used for triangles, for instance), a manufacturer may create a cover that works best for the situation at hand.

Service workers and persons adjusting the bedding using the present cover 20 may realize fewer (or no) instances of panel 24 riding upward to expose the box spring while also experiencing a better fit of the cover 20 with less or no wrinkling. A more finished bedding look is achieved, and may be achieved with minimal effort. This saves money in terms of reduced labor required to make a bed (i.e., to change or adjust bedding) which is especially important in the hotel and housing industries.

In one aspect with respect to FIG. 3, panel 24 and panel 26 are made of the same variety of material or fabric. The fabric may include decorative fabric or design. Different colors may be used from panel to panel, or adjacent panels may be continuous as shown in FIG. 3. Corner 60 is shown having an exposed decorated fabric or surface that matches the surface at panel 24 and panel 26. In this example panel 24 and panel 26 are made of a continuous layer of fabric. Triangle 40 is concealed from view and results in a smooth edge along the box spring with little or no ripple of panel 24. A headboard seam 78 may be included to connect panels or portions of panels together.

Figure 9:
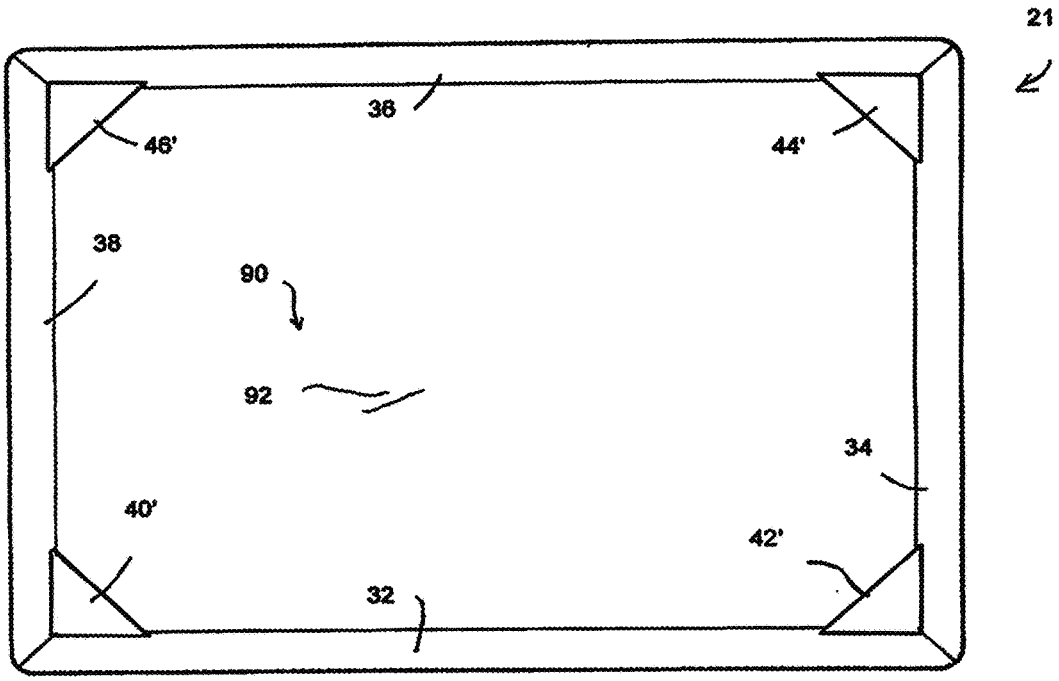
FIG. 9 is a top view of a cover in accordance with another aspect of the present invention and positioned on a box spring.
Figure 10:
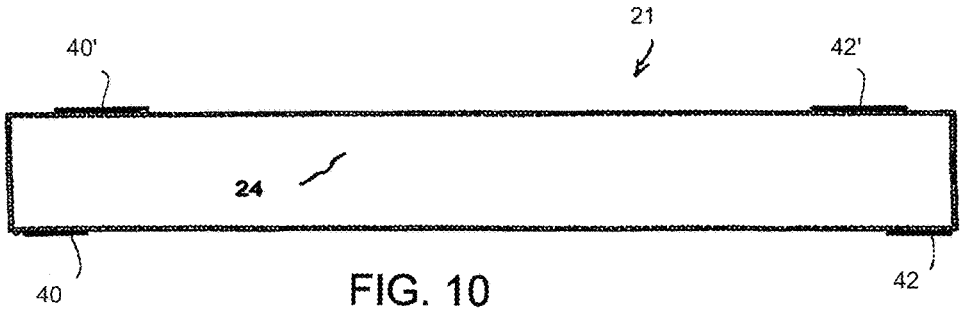
FIG. 10 is a side view of the cover of FIG. 9.

Referring to FIG. 9, a top portion of cover 21 includes a platform 32 which is positioned about a perimeter of cover 21. Platform includes platform segments 32, 34, 36 and 38 which are configured in a generally rectangular pattern. In this aspect, cover 21 is devoid of a decking panel, such as a decking panel 22 that otherwise appears in other aspects noted above. Instead, cover 21 has a relatively open top area which reveals a screen 92 of a box spring 90. Screen 92 is typically a light-weight fabric that may be stapled, for instance, to the structural supports of box spring 90. Screen 92 in some instances includes a light-weight black colored fabric used to screen from view the inside areas of box spring 90. Screen 92 may be made of other materials.

Cover 21 includes elastic panels 40', 42', 44' and 46'. Panels in this aspect are triangular. Triangle 40' is sewn to platform segments 32 and 38, for instance. It may be appreciated that triangle 40' will provide tension to adjacent platform segments 32 and 38. Triangle 40' is positioned at an interior edge of platform segment 32. In this arrangement triangle 40' is less likely to become visible if a mattress were to shift atop box spring 90. Triangle 40' assists in maintaining platform segments 32, 38 is a relatively horizontal orientation with respect to side panels 24 of cover 21. A side panel 24 of cover 21 hangs downward from platform 32. In one aspect, cover 21 includes a hem 50 and triangles 40, 42, 44 and 46 at an underside of cover 21. For instance, the hem 50 and triangle 40 structures noted above may be included at an underside portion of cover 21 (i.e., the structures shown in FIG. 3 may be provides to cover 21 of FIG. 9). In such arrangement cover 21 operates as a "hugger" to hug or cover the perimeter edge of box spring 90. In this manner, cover 21 may effectively provide a smooth and wrinkle-free appearance to box spring 90. Because cover 21 lacks a decking panel (such as decking panel 22) cover 21 may be manufactured with less material and at less cost. Use of triangle 40' at an upper portion of cover 21, together with triangle 40, for instance, at a lower or underneath portion of cover 21, provides a simultaneous tension to hem 50 and platform 32. Such simultaneous tension tends to maintain hem 50 and platform 32 in relatively horizontal orientations, and tending to provide a tension force to side panel 24 to enhance or maintain side panel 24 in a wrinkle-free state. Having such simultaneous tension to both top and bottom helps to maintain the wrinkle-free state even through use of the box spring and mattress. Further, platform 32 may be made of a rubberized material or other gripper cloth product having a texture and ability to adhere or have a greater friction relationship with an edge of platform 90. In an example where platform 32 (or 34, 36, 38) is a rubberized layer, platform 32 will exhibit a greater tendency to resist a sliding movement when side panel 24 is forced upward (or downward), for instance. A gripping material applied platform will help maintain hem horizontally) to better secure cover 20 into position. In one aspect, a portion of platform 32 may be provided with the gripping element.

Panel 40' (and panel 40) may include a finished leg at the hypotenuse and each leg may include a raw edge that is passed through a serger device to prevent fraying. Panels 40, 40' may be die cut to a desired shape.

While panel 40 may comprise a stretchable material configured in a non-triangular shape, the use of a triangular shape allows for significant tension upon the hems in at least two dimensions (i.e., pulling a hem, such as pulling hem 50 toward the corner while also pulling the hem inward or toward the center of the foundation. Having the panel 40 configured as a triangular panel that is stretched while being stitched allows for a desired consistent force to be exerted on the hems.

In one aspect panel 40 (and similar panels) is cut or configured at 90 degrees, i.e., as shown in FIG. 3, a first leg 70 of triangle 40, for instance, is oriented perpendicularly to second leg 72 of triangle 40. In other aspects, triangle 40 is configured such that first leg 70 and second leg 72 are oriented at less than 90 degrees. In one aspect first leg 70 and second leg 72 are cut or created to be oriented at 88 degrees. Different degree orientations may be used depending on the desired flexibility of cover 20, type of fabrics being used, length of box spring, etc. When triangle 40 is secured to cover 20, by sewing, for instance, first leg 70 and second leg 72 may be oriented at 90 degrees. Pre-stretching triangle 40 before sewing to cover 20 allows for triangle 40 to impart a slight smoothing force (and as referenced above, orients hem 50 relatively horizontally). Triangle 40 may be pre-stretched or cut at a smaller angle and sewn to cover 20 at angles other than 90 degrees to obtain a desired fitting force.

In a further aspect the invention includes a method of manufacture which includes configuring triangle 40 to have a measure at angle A (See FIG. 4) from first leg 70 to second leg 72 at a pre-sewn position that is less than a measure at angle A at a post-sewn position. For instance, triangle 40 is configured to be stretched (even slightly, or greater) and then sewn into position. In one aspect, first leg 70, for instance, is sewn to hem 50 along or about stitch line SL-2. Triangle 40 is then stretched and second leg 72 is sewn along a corresponding stitch line SL-2. The process may also be conducted by starting with second leg 72 and finishing with first leg 70. It may be appreciated that triangle 40 may be temporarily held into position (i.e., via pins or other holders) while stitches along stitch line SL-2 (or at least partially along stitch line SL-2) are stitched into the fabrics. A variety of styles or patterns of stitching may be used as desired. In a further aspect the invention includes a method of covering a box spring comprising applying a cover 20 or 21 of the nature describe herein.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular BED FOUNDATION AND METHOD OF FABRICATION as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A cover for placement on a bed foundation, the cover comprising:

a set of four side panels configured in a rectangular orientation to define four corners and to fit over edges of a bed foundation;

at least one stretchable corner panel positioned at at least one of the corners, an entirety of the stretchable corner panel positioned at an underside of the at least one corner;

at least two of the side panels including a hem configured to extend under edges of the foundation where at least one of the hems includes a toe wrapped over a foot, the toe having a terminal edge substantially aligned with at least one edge of the foundation; and where the at least one of the at least two side panels and the at least one of the hems define an elbow having a generally perpendicular internal angle, the terminal edge positioned adjacent the elbow within the internal angle.

2. The cover of claim 1 where the elbow is configured to cover an outer corner of a side structure of the foundation.

3. The cover of claim 1 where the terminal edge defines a terminal linear edge which spans substantially a length of at least one of the side panels.

4. The cover of claim 3 where the terminal linear edge is configured to abut an outer corner of a side structure of the foundation.

5. The cover of claim 1 where the terminal edge is positioned between the foot and an edge of a side structure of the foundation when the cover is positioned on the foundation.

6. The cover of claim 5 where the toe is rubberized.

7. The cover of claim 1 where a stretchable triangular corner panel is positioned at each of the four corners, each of the side panels leads to a respective hem, each of the stretchable triangular corner panels is sewn to a respective hem such that each of the hems is oriented at a generally perpendicular angle with respect to respective side panels.

8. A cover for use in conjunction with a bed foundation, having four vertical side structures having bottom edges the cover comprising:

four side panels configured to fit over edges of the foundation and defining four cover corners that fit at corners of the foundation;

at least one stretchable panel positioned at one of the cover corners and configured to be oriented at an underside of the foundation; and at least one of said four side panels includes a hem positioned at an underside of the bed foundation to which said cover fits, the hem is configured to abut the bottom edge of a respective side structure while oriented perpendicular to each side panel.

9. The cover of claim 8 where the hem includes a toe wrapped over and stitched to a foot of the hem along a first stitch line, the stretchable panel comprising a triangular panel stitched to the hem along a second stitch line and along a third stitch line.

10. The cover of claim 9 where the second stitch line is positioned substantially over the first stitch line.

11. The cover of claim 10 where the second stitch line is positioned proximal the bottom edge and the third stitch line is positioned distal the bottom edge.

12. The cover of claim 8 further comprising at least two platform members positioned at a topside of the bed foundation to which the cover fits, the platform members and at least two of the side panels defining a top edge of the cover, a stretchable triangular panel connected to the at least two platform members at at least one of the four cover corners, the triangular panel offset from the top edge.

13. The cover of claim 12 further comprising a decking panel configured to cover the topside.

14. The cover of claim 8 where a triangular stretching panel is positioned at each of the four cover corners, and a hem positioned at an underside of each of the edges of the foundation, the triangular stretching panels configured to maintain each of the hems in a horizontal orientation at the underside edges.

15. The cover of claim 8 where the at least one stretchable panel is offset from the bottom edge.

16. A cover for use in conjunction with a bed foundation having four vertical side structures having bottom edges, the cover comprising:

four side panels configured to fit over the side structures of the foundation and defining four cover corners that fit at corners of the foundation; and each of the four side panels includes a hem positioned at an underside of the bed foundation to which the cover fits, each hem is configured to abut the bottom edge of a respective side structure while oriented perpendicular to each side panel and spans substantially an entire length of a respective side panel and includes a toe wrapped over a foot, the toe having a terminal edge positioned between the foot and the bottom edge of a respective side structure and adjacent a respective outer corner of the side structure when the cover is positioned on the foundation.

17. The cover of claim 16 where at least one of the side panels and one of the hems define an elbow having a generally perpendicular internal angle, the terminal edge positioned adjacent the elbow within the internal angle.

18. The cover of claim 16 further comprising at least one stretchable panel positioned at one of the cover corners.

19. A cover for placement on a bed foundation, the cover comprising:

a set of four side panels configured in a rectangular orientation to define four corners and to fit over edges of a bed foundation;

at least one stretchable corner panel positioned at at least one of the corners, an entirety of the stretchable corner panel positioned at an underside of the at least one corner;

at least two of the side panels including a hem configured to extend under and abut edges of the foundation where at least one of the hems includes a toe wrapped over a foot the toe having a terminal edge; and where the at least one of the at least two side panels and the at least one of the hems define an elbow having a generally perpendicular internal angle, the terminal edge positioned adjacent the elbow within the internal angle.

* * * * *